US010497318B2

(12) United States Patent
Zhang

(10) Patent No.: US 10,497,318 B2
(45) Date of Patent: Dec. 3, 2019

(54) MURA COMPENSATION METHOD FOR DISPLAY PANEL AND DISPLAY PANEL

(71) Applicant: Shenzhen China Star Optoelectronics Technology Co., Ltd., Shenzhen, Guangdong (CN)

(72) Inventor: Hua Zhang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 146 days.

(21) Appl. No.: 15/552,293

(22) PCT Filed: May 24, 2017

(86) PCT No.: PCT/CN2017/085745
§ 371 (c)(1),
(2) Date: Aug. 20, 2017

(87) PCT Pub. No.: WO2018/201533
PCT Pub. Date: Nov. 8, 2018

(65) Prior Publication Data

US 2018/0342211 A1 Nov. 29, 2018

(30) Foreign Application Priority Data

May 3, 2017 (CN) ..... 2017 1 0305935

(51) Int. Cl.
*G09G 3/34* (2006.01)
*G09G 3/20* (2006.01)
*G09G 3/36* (2006.01)

(52) U.S. Cl.
CPC ..... *G09G 3/34* (2013.01); *G09G 3/2092* (2013.01); *G09G 3/3611* (2013.01);
(Continued)

(58) Field of Classification Search
CPC ..... G09G 3/34; G09G 3/36; G09G 3/2092; G09G 3/3611; G09G 2320/0233; G09G 2320/0285; G09G 2320/0693
See application file for complete search history.

(56) References Cited

U.S. PATENT DOCUMENTS 8,502,840 B2 * 8/2013 Lee ..... G09G 3/3406 345/690
9,472,132 B2 10/2016 Kaplan et al.
(Continued)

FOREIGN PATENT DOCUMENTS

CN 101169922 A 4/2008
CN 104992657 A 10/2015
(Continued)

OTHER PUBLICATIONS

First Office Action of CN2017103059354.
Office Action of CN2017103059354.

*Primary Examiner* — Tom V Sheng
(74) *Attorney, Agent, or Firm* — Andrew C. Cheng

(57) ABSTRACT

A mura compensation method for display panel is disclosed, including: storing a specific grayscale compensation data table in a timing controller, in which the specific grayscale compensation data table being used for performing grayscale compensation to a fix mura area in the display panel; obtaining a current grayscale of the display panel; based on the specific grayscale compensation data table, performing grayscale compensation to the current grayscale of a pixel in the fixed mura area of the display panel. A display panel is close disclosed.

4 Claims, 4 Drawing Sheets

(52) U.S. Cl.
CPC ..... *G09G 2320/0233* (2013.01); *G09G 2320/0285* (2013.01); *G09G 2320/0693* (2013.01)

(56) References Cited

U.S. PATENT DOCUMENTS

| | | | | |
|---|---|---|---|---|
| 2007/0132895 | A1* | 6/2007 | Shen | G09G 3/2007 349/1 |
| 2011/0102452 | A1* | 5/2011 | Yun | G09G 3/342 345/589 |
| 2015/0070403 | A1* | 3/2015 | Kim | G09G 3/3607 345/690 |
| 2015/0187289 | A1* | 7/2015 | Kim | G01M 11/064 345/89 |
| 2015/0187303 | A1* | 7/2015 | Choi | G09G 3/20 345/691 |
| 2016/0171939 | A1* | 6/2016 | Na | G09G 3/20 345/690 |
| 2016/0284308 | A1* | 9/2016 | Jeon | G09G 3/3406 |
| 2017/0193933 | A1* | 7/2017 | Zhang | G09G 3/36 |
| 2017/0193959 | A1* | 7/2017 | No | G09G 3/3688 |
| 2017/0206825 | A1* | 7/2017 | Cha | G09G 3/2092 |
| 2017/0243562 | A1* | 8/2017 | Hu | G09G 3/2092 |
| 2018/0040295 | A1* | 2/2018 | Deng | G09G 3/2007 |
| 2018/0122282 | A1* | 5/2018 | He | G09G 3/2003 |
| 2018/0182321 | A1* | 6/2018 | Zeng | G09G 3/3607 |
| 2018/0190214 | A1* | 7/2018 | Kim | G09G 3/20 |
| 2018/0204529 | A1* | 7/2018 | Chen | G09G 3/006 |
| 2018/0218693 | A1* | 8/2018 | Zhang | G09G 3/3607 |

FOREIGN PATENT DOCUMENTS

| | | | |
|---|---|---|---|
| CN | 105244001 | A | 1/2016 |
| CN | 105609063 | A | 5/2016 |
| CN | 105609084 | A | 5/2016 |
| CN | 105632443 | A | 6/2016 |
| CN | 105679265 | A | 6/2016 |
| KR | 20050055159 | A | 6/2005 |

* cited by examiner

MURA COMPENSATION METHOD FOR DISPLAY PANEL AND DISPLAY PANEL

CROSS REFERENCE TO RELATED APPLICATIONS

This application claims the priority of Chinese Patent Application No. CN201710305935.4, entitled "Mura Compensation Method for Display Panel and Display Panel", filed on May 3, 2017, the disclosure of which is incorporated herein by reference in its entirety.

BACKGROUND OF THE INVENTION

1. Field of the Invention

The present invention relates to the field of display, and in particular to the field of mura phenomenon compensation method for display panel and display panel.

2. The Related Arts

Because of various defects in the manufacturing process of liquid crystal display (LCD), the manufactured LCD panel may have non-uniform luminance and display various mura phenomena (the mura phenomenon refers to the marks caused by non-uniform luminance of the display panel.)

To improve the luminance uniformity of the display panel, some mura compensation methods are developed. For example, an external high-resolution camera is used to take a few grayscale frames (pure white screen with different luminance) mura forms. By comparing the brightness of the center position of the display panel, the brightness difference between the surrounding area and the center position is computed, and then compensates the grayscale value of the mura location (by reducing the grayscale value for area brighter than the center position to reduce brightness, and increasing the grayscale value for area darker than the center to increase brightness) to make the display panel as a whole to achieve a more consistent brightness.

The known display panel is manufactured in a batch. When a process malfunctions, an abnormal luminance will show up at a fixed location in the active areas of a batch of display panels. The general situation would be small-area white spot, dark spot or horizontal bright band. This type of abnormal situation is often more obvious in grayscale screen. The known mura compensation method, even when mura phenomenon only occurs at some fixed locations, needs to store grayscale compensation values for all the pixels in the active area of the display panel, resulting in the display panel needing a large amount of storage space, and leading to higher cost.

SUMMARY OF THE INVENTION

The primary object of the present invention is to provide a mura compensation method for display panel and display panel, to alleviate the non-uniform luminance problem of the display panel.

To solve the above problem, the present invention provides a mura compensation method for display panel, comprising:

storing a specific grayscale compensation data table in a timing controller, wherein the specific grayscale compensation data table being used for performing grayscale compensation to a fix mura area in the display panel;

obtaining a current grayscale of the display panel;

based on the specific grayscale compensation data table, performing grayscale compensation to the current grayscale of a pixel in the fixed mura area of the display panel.

According to an embodiment of the present invention, the step of based on the specific grayscale compensation data table, performing grayscale compensation to the current grayscale of a pixel in the fixed mura area of the display panel comprises:

obtaining a grayscale compensation value corresponding to the current grayscale of the pixel in the fixed mura area from the specific grayscale compensation data table;

based on the corresponding grayscale compensation value, performing grayscale compensation to the pixel in the fixed mura area of the display panel.

According to an embodiment of the present invention, the fixed mura area comprises k pixels, k is an integer greater than or equal to 2; the specific grayscale compensation data table comprises a grayscale compensation value for each pixel of the k pixels at 0-255 grayscales, or the specific grayscale compensation data table comprises a grayscale compensation value for each pixel of the k pixels at a plurality of specific grayscales.

According to an embodiment of the present invention, a ratio between area of the fixed mura area and area of the display panel active area is less than or equal to 1/10.

According to an embodiment of the present invention, the fixed mura area is a high luminance mura area or a high dark mura area, and the method further comprises:

obtaining supplementary grayscale compensation values corresponding to for all pixels in the fixed mura area;

based on the supplementary grayscale compensation values, performing grayscale compensation to all pixels in the fixed mura area of the display panel.

According to an embodiment of the present invention, the fixed mura area comprises k pixels, k is an integer greater than or equal to 2; the specific grayscale compensation data table comprises a grayscale compensation value for each pixel of the k pixels at 0-255 grayscales, the k pixels have the same grayscale compensation value at the same grayscale.

According to an embodiment of the present invention, the method comprises a step before the step of obtaining benchmark grayscale compensation values for all the pixels in the display panel:

storing the supplementary grayscale compensation values of all the pixels in the fixed mura area in a data memory.

The present invention also provides a display panel, comprising:

a storage unit, for storing a specific grayscale compensation data table, the storage unit being in a timing controller, wherein the specific grayscale compensation data table being used for performing grayscale compensation to a fix mura area in the display panel;

a first obtaining unit, for obtaining a current grayscale of the display panel;

a first processing unit, for, based on the specific grayscale compensation data table, performing grayscale compensation to the current grayscale of a pixel in the fixed mura area of the display panel.

According to an embodiment of the present invention, the first processing unit comprises:

a second obtaining unit, for obtaining a grayscale compensation value corresponding to the current grayscale of the pixel in the fixed mura area from the specific grayscale compensation data table;

a first processing sub-unit, for, based on the corresponding grayscale compensation value, performing grayscale compensation to the pixel in the fixed mura area of the display panel.

According to an embodiment of the present invention, the display panel further comprises:

a third obtaining unit, for obtaining supplementary grayscale compensation values corresponding to for all pixels in the fixed mura area;

a second processing unit, for, based on the supplementary grayscale compensation values, performing grayscale compensation to all pixels in the fixed mura area of the display panel.

The embodiments of the present invention provides the following advantages:

Because the timing controller stores the specific grayscale compensation data table, wherein the specific grayscale compensation data table is used for performing grayscale compensation to a fix mura area in the display panel; based on the specific grayscale compensation data table, the display panel performs grayscale compensation to the current grayscale of a pixel in the fixed mura area of the display panel. Therefore, the display panel does not need to perform grayscale compensation to the pixels in the entire active area, and the stored data amount of grayscale compensation values for mura compensation is less so that the data can be stored in the timing controller of the display panel. As a result, the cost is reduced and the display panel achieves a better display quality.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort.

DETAILED DESCRIPTION OF THE PREFERRED EMBODIMENTS

To further explain the technical means and effect of the present invention, the following refers to embodiments and drawings for detailed description. Apparently, the described embodiments are merely some embodiments of the present invention, instead of all embodiments. All other embodiments based on embodiments in the present invention and obtained by those skilled in the art without departing from the creative work of the present invention are within the scope of the present invention.

The terms "comprising" and "having" and any variations thereof appearing in the specification, claims, and drawings of the present application are intended to cover non-exclusive inclusion. For example, a process, method, system, product, or device that includes a series of steps or units is not limited to the listed steps or units, but optionally also includes steps or units not listed, or alternatively, other steps or units inherent to these processes, methods, products or equipment. In addition, the terms "first", "second" and "third" are used to distinguish different objects, and are not intended to describe a particular order.

The First Embodiment

Figure 1:
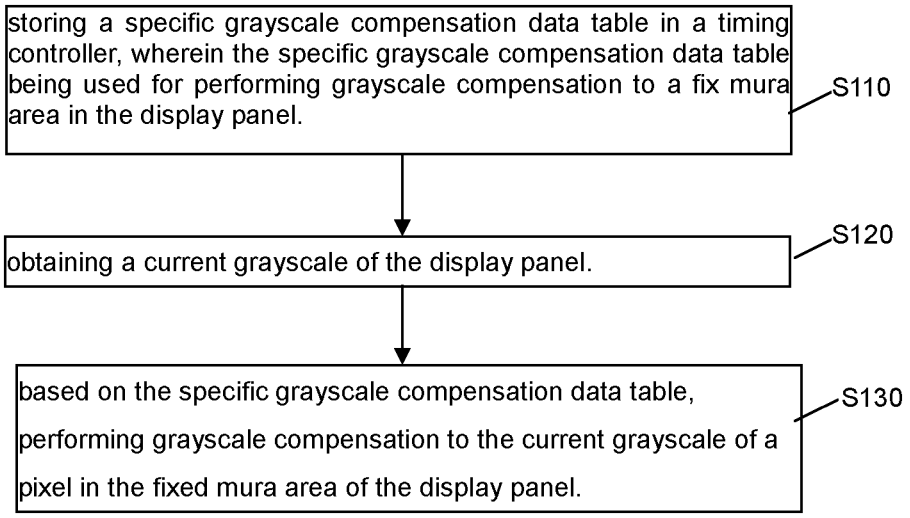
FIG. 1 is a flowchart showing the mura compensation method for display panel according to a first embodiment of the present invention.

The first embodiment of the present invention provides a mura compensation method for display panel. The display panel can be a liquid crystal display panel or other types of display panels. Refer to FIG. 1. The method comprises:

S110: storing a specific grayscale compensation data table in a timing controller, wherein the specific grayscale compensation data table being used for performing grayscale compensation to a fix mura area in the display panel.

In the present embodiment, when the active area of the display panel shows fixed mura areas, for example, the active area shows fixed black spots/band area, white spots/band area, and so on, the fixed mura area comprises, i,e., the fixed black spots/band area, white spots/band area. The fixed mura must be smaller in area. In general, the ratio between the fixed mura area and the active area of the display panel is less than or equal to $1/10$, such as, $1/10$, $1/15$, $1/20$, $1/25$, $1/30$, $1/40$, $1/50$, $1/60$, $1/70$, $1/80$, $1/90$, $1/100$, and so on. The number of fixed mura areas having the fixed black spots/band area, white spots/band area can be one or a plurality. Because the area of the fixed mura area is smaller, the number of pixels included is also less. In the present embodiment, the fixed mura area comprises k pixels, k is an integer greater than or equal to 2; such as, 2, 6, 10, 20, 30, 40, 50, 60, 70, 80, 90, 100, 200, 300, 400, 500, 1000, and so on.

To perform grayscale compensation on the fixed mura area to lessen the mura phenomenon at the fixed mura area, i.e., to alleviate the non-uniform luminance problem of the fixed area, in the present embodiment, the compensation values for the fixed mura area are arranged by an external mura repair system into a specific grayscale compensation data table. Then, the specific grayscale compensation data table is stored. The specific grayscale compensation data table comprises the compensation values for each of the k pixels at 0-255 grayscales, as shown in the following table:

| | Compensation data | | | |
|---|---|---|---|---|
| | Compensation value for grayscale 0 | Compensation value for grayscale 1 | . . . | Compensation value for grayscale 255 |
| $1^{st}$ pixel | 1 | 1 | . . . | 5 |
| $2^{nd}$ pixel | 2 | 1 | . . . | 3 |
| . . . | . . . | . . . | . . . | . . . |
| k-th pixel | −1 | −2 | . . . | −3 |

Accordingly, only the specific grayscale compensation data table is stored, instead of the compensation data for the entire display panel active area, so that the storage space is reduced and the cost is lowered. In the present embodiment, because the data amount is small, the specific grayscale compensation data table can be stored in a timing controller (Tcon IC) so that the display panel does not need a data memory (flash). Moreover, in other embodiments of the present invention, the specific grayscale compensation data table comprises a grayscale compensation value for each pixel of the k pixels at a plurality of specific grayscales. In this approach, the storage space is further reduced. For example, for each pixel, the specific grayscale compensation data table only stores a grayscale compensation value at a low grayscale range, such as, the grayscale compensation value corresponding to grayscale 20; a grayscale compensation value at a middle grayscale range, such as, the grayscale compensation value corresponding to grayscale 128; and a grayscale compensation value at a high grayscale range, such as, the grayscale compensation value corresponding to grayscale 200. The other grayscale compensation values for the pixel at other grayscales can be calculated by the timing controller with linear interpolation method. Because the linear interpolation calculation is a widely known technique, the details will not be described here.

Furthermore, in the present embodiment, the display panel is manufactured in a batch. When a process malfunctions, an abnormal luminance will show up at a fixed location in the active areas of a batch of display panels. As a result, after the specific grayscale compensation data table is obtained, the entire batch of display panels can be recorded with the specific grayscale compensation data table for convenience in subsequent processing.

S120: obtaining a current grayscale of the display panel.

When the display panel displays, the display panel obtains the current grayscale of the active area, and as a result, the current grayscale of the fixed mura area can also be obtained.

S130: based on the specific grayscale compensation data table, performing grayscale compensation to the current grayscale of a pixel in the fixed mura area of the display panel.

When the display panel displays, the display panel performs grayscale compensation to the current grayscale of a pixel in the fixed mura area of the display pane according to the specific grayscale compensation data table. After performing the grayscale compensation to the fixed mura area, the display panel can reduce the non-uniform luminance between the fixed mura area and other areas of the active area, leading to the overall display quality improved in the display panel.

In the present embodiment, because the timing controller stores the specific grayscale compensation data table, wherein the specific grayscale compensation data table is used for performing grayscale compensation to a fix mura area in the display panel; based on the specific grayscale compensation data table, the display panel performs grayscale compensation to the current grayscale of a pixel in the fixed mura area of the display panel. Therefore, the display panel does not need to perform grayscale compensation to the pixels in the entire active area, and the stored data amount of grayscale compensation values for mura compensation is less so that the data can be stored in the timing controller of the display panel. As a result, the cost is reduced and the display panel achieves a better display quality.

In the present embodiment, the step of based on the specific grayscale compensation data table, performing grayscale compensation to the current grayscale of a pixel in the fixed mura area of the display panel comprises:

obtaining a grayscale compensation value corresponding to the current grayscale of the pixel in the fixed mura area from the specific grayscale compensation data table.

In the present embodiment, the fixed mura area comprises k pixels, and each pixel has a corresponding grayscale compensation value at each grayscale. Accordingly, the display panel must obtain the grayscale compensation value corresponding to the current grayscale of each of the k pixels from the specific grayscale compensation data table.

based on the corresponding grayscale compensation value, performing grayscale compensation to the pixels in the fixed mura area of the display panel.

In the present embodiment, after the display panel obtains grayscale compensation value corresponding to the current grayscale of each of the k pixels, the display panel performs grayscale compensation to the pixels in the fixed mura area of the display panel according to the corresponding grayscale compensation value. Specifically, the current grayscale of the pixels in the fixed mura area and the corresponding grayscale compensation value are stacked, and the stacked grayscale is the displayed grayscale of the pixel When the grayscale compensation value is positive, the current grayscale is increased to increase the luminance; when the grayscale compensation value is negative, the current grayscale is decreased to decrease the luminance.

Figure 2:
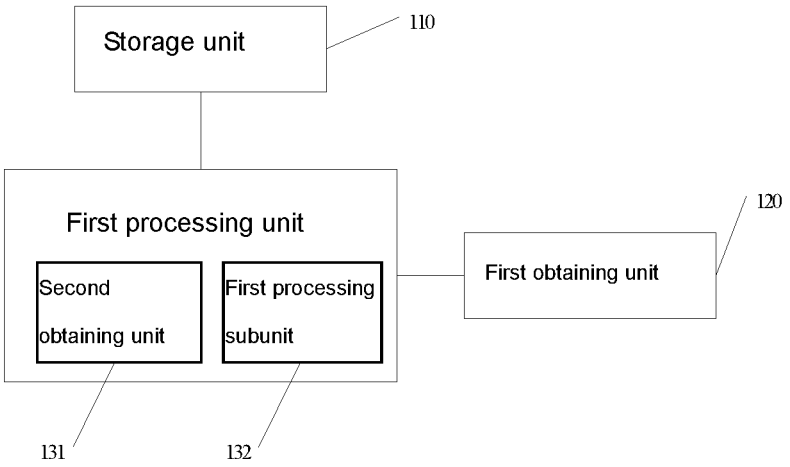
FIG. 2 is a schematic view showing the display panel of the first embodiment of the present invention.

The present invention also provides a display panel, as shown in FIG. 2, comprising:

a storage unit 110, for storing a specific grayscale compensation data table, the storage unit 110 being in a timing controller (Tcon IC), wherein the specific grayscale compensation data table being used for performing grayscale compensation to a fix mura area in the display panel.

In the present embodiment, when the active area of the display panel shows fixed mura areas, for example, the active area shows fixed black spots/band area, white spots/band area, and so on, the fixed mura area comprises, i,e., the fixed black spots/band area, white spots/band area. The fixed mura must be smaller in area. In general, the ratio between the fixed mura area and the active area of the display panel is less than or equal to 1/10. The number of fixed mura areas having the fixed black spots/band area, white spots/band area can be one or a plurality. Because the area of the fixed mura area is smaller, the number of pixels included is also less. In the present embodiment, the fixed mura area comprises k pixels, k is an integer greater than or equal to 2.

To perform grayscale compensation on the fixed mura area to lessen the mura phenomenon at the fixed mura area, i.e., to alleviate the non-uniform luminance problem of the fixed area, in the present embodiment, the compensation values for the fixed mura area are arranged by an external mura repair system into a specific grayscale compensation data table. Then, the specific grayscale compensation data table is stored in the storage unit 110. The specific grayscale compensation data table comprises the grayscale compensation value of each of the k pixels at 0255 grayscales. The storage unit 110 is located in the timing controller (Tcon IC) of the display panel.

a first obtaining unit 120, for obtaining a current grayscale of the display panel.

When the display panel displays, the first obtaining unit 120 obtains the current grayscale of the active area; accordingly, the first obtaining unit 120 also obtains the current grayscale of the fixed mura area.

a first processing unit 130, for, based on the specific grayscale compensation data table, performing grayscale compensation to the current grayscale of a pixel in the fixed mura area of the display panel.

When the display panel displays, the first processing unit 130 performs grayscale compensation to the current grayscale of a pixel in the fixed mura area of the display pane according to the specific grayscale compensation data table. After performing the grayscale compensation to the fixed mura area, the display panel can reduce the non-uniform luminance between the fixed mura area and other areas of the active area, leading to the overall display quality improved in the display panel.

In the present embodiment, the storage unit 110, the first obtaining unit 120, and the first processing unit 130 can be all integrated into a single device of the display panel, such as a timing controller (Tcon IC). Apparently, the storage unit 110, the first obtaining unit 120, and the first processing unit 130 can be individual component.

In the present embodiment, the first processing unit 130 specifically comprises:

a second obtaining unit 131, for obtaining a grayscale compensation value corresponding to the current grayscale of the pixel in the fixed mura area from the specific grayscale compensation data table.

In the present embodiment, the fixed mura area comprises k pixels, and each pixel has a corresponding grayscale compensation value at each grayscale. Accordingly, the second obtaining unit 131 must obtain the grayscale compensation value corresponding to the current grayscale of each of the k pixels from the specific grayscale compensation data table.

a first processing sub-unit 132, for, based on the corresponding grayscale compensation value, performing grayscale compensation to the pixel in the fixed mura area of the display panel.

In the present embodiment, after the second obtaining unit 131 obtains grayscale compensation value corresponding to the current grayscale of each of the k pixels, the first processing sub-unit 132 performs grayscale compensation to the pixels in the fixed mura area of the display panel according to the corresponding grayscale compensation value. Specifically, the current grayscale of the pixels in the fixed mura area and the corresponding grayscale compensation value are stacked, and the stacked grayscale is the displayed grayscale of the pixel When the grayscale compensation value is positive, the current grayscale is increased to increase the luminance; when the grayscale compensation value is negative, the current grayscale is decreased to decrease the luminance.

Furthermore, in other embodiments, the fixed mura area may comprise high luminance area or high dark area. The high luminance area or the high dark area may need grayscale compensation value exceeding the compensable range, such as, exceeding the range of grayscale −127 to grayscale +127. Accordingly, after the first grayscale compensation, there may still be visible mura phenomenon. For such situations, the present invention uses a second embodiment for explanation.

The Second Embodiment

Figure 3:
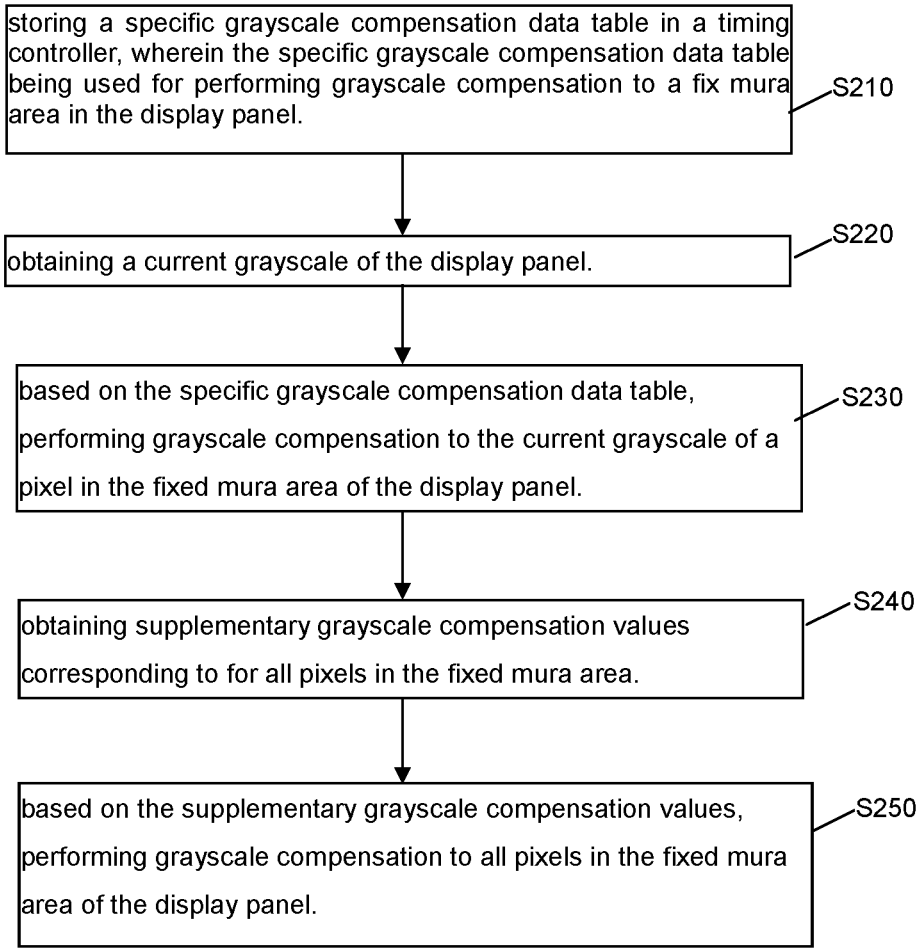
FIG. 3 is a flowchart showing the mura compensation method for display panel according to a second embodiment of the present invention.

FIG. 3 shows a flowchart of a second embodiment of mura compensation method for display panel according to the present invention. The flowchart is similar to the flowchart in FIG. 1. The main difference between the present embodiment and the first embodiment is to perform a second-time grayscale compensation on the fixed mura area. Refer to FIG. 3. The method comprising:

S210: storing a specific grayscale compensation data table in a timing controller, wherein the specific grayscale compensation data table being used for performing grayscale compensation to a fix mura area in the display panel.

In the present embodiment, the fixed mura area is a high luminance mura area or a high dark mura area. The grayscale compensation values from the specific grayscale compensation data table are for lessening the the mura phenomenon at the high luminance mura area or the high dark mura area. For example, for high luminance mura area, the grayscale compensation values from the specific grayscale compensation data table are used for reducing the luminance; and high dark mura area, the grayscale compensation values from the specific grayscale compensation data table are used for increasing the luminance so that the high luminance or high dark mura area, after grayscale compensation, can fall into the range able for grayscale compensation.

In the present embodiment, the fixed mura area comprises k pixel, and k is an integer greater than or equal to 2. The specific grayscale compensation data table comprises the compensation values for each of the k pixels at 0-255 grayscales. In the present embodiment, the k pixels have the same grayscale compensation value at the same grayscale to save storage space. The specific grayscale compensation data table (high dark mura area), for example, is as follows:

| | Compensation data | | | |
|---|---|---|---|---|
| | Compensation value for grayscale 0 | Compensation value for grayscale 1 | . . . | Compensation value for grayscale 255 |
| $1^{st}$ pixel | 1 | 5 | . . . | 3 |
| $2^{nd}$ pixel | 1 | 5 | . . . | 3 |
| . . . | . . . | . . . | . . . | . . . |
| k-th pix el | 1 | 5 | . . . | 3 |

Apparently, in other embodiments of the present invention, the compensation values for the k pixels at 0-255 grayscales can be designed to be the same, for example, the value is 10 when high dark, so as to further save storage space. Moreover, in other embodiments, the compensation values for k pixels can be partially the same, and the partially different.

S220: obtaining a current grayscale of the display panel.

S230: based on the specific grayscale compensation data table, performing grayscale compensation to the current grayscale of a pixel in the fixed mura area of the display panel.

In the present embodiment, the display panel performs grayscale compensation to the current grayscale of a pixel in the fixed mura area of the display pane according to the specific grayscale compensation data table. This grayscale compensation can be viewed as the initial grayscale compensation. After the grayscale compensation, the high dark mura area becomes brighter and high luminance area becomes darker. After grayscale compensation, the high luminance or high dark mura area can fall into the range able for grayscale compensation.

S240: obtaining supplementary grayscale compensation values corresponding to for all pixels in the fixed mura area.

Accordingly, because after the compensation with grayscale values from the specific grayscale compensation data table, the high dark mura area and high luminance area in the fixed mura area is lessened. For further improving on the display effect, the display panel further obtains supplementary grayscale compensation values corresponding to for all pixels in the fixed mura area. In the present embodiment, some of the supplementary grayscale compensation values can comprise the grayscale compensation values for all pixels in the active area of the known display panel, i.e., some of the supplementary grayscale compensation values can correspond to the grayscale compensation values for all pixels in the fixed mura area in known technology. In the other embodiments, these supplementary grayscale compensation values can be individually provided compensation values, such as, obtained through an external mura repair system.

S250: based on the supplementary grayscale compensation values, performing grayscale compensation to all pixels in the fixed mura area of the display panel.

In the present embodiment, moreover, the grayscale compensation is performed to all pixels in the fixed mura area of the display pane with the compensation data from the supplementary grayscale compensation values. Accordingly, after the further compensation, the high dark mura area and high luminance area in the fixed mura area is further lessened. After two times of grayscale compensation, the mura phenomenon in the high luminance or high dark mura area can be greatly reduced so as to improve the display effect of the display panel. In addition, in other embodiments of the present invention, the display panel can perform three, four or more times of grayscale compensation to the pixel in the fixed mura area. Also, steps S230 and S250 can be executed in different orders. The step S230 can be executed first, and the step S250, or, vice versa, or even simultaneously.

In addition, in the present embodiment, the method comprises a step before the step S240:

storing the supplementary grayscale compensation values of all the pixels in the fixed mura area in a data memory.

Accordingly, the supplementary grayscale compensation values are pre-stored in the display panel, preferably, a data memory (flash). Because of the large amount of grayscale compensation data for all pixels in the known display panel, the data is stored in the data memory. Accordingly, the present invention does not need to target this part for further improvement. Apparently, in other embodiments, the supplementary grayscale compensation values can also be stored in other memory of the display panel. Also, the supplementary grayscale compensation values are obtained by an external mura repair system.

Figure 4:
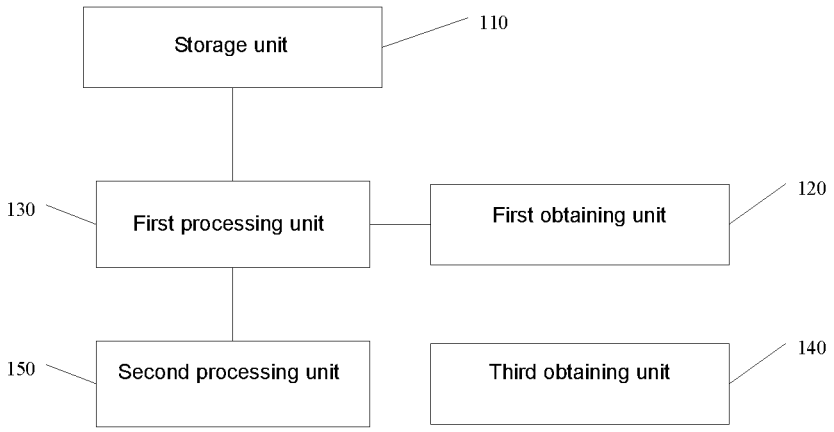
FIG. 4 is a schematic view showing the display panel of the second embodiment of the present invention.

The present invention also provides a display panel, as shown in FIG. 4. The structure shown in FIG. 4 is similar to the structure in FIG. 2. Therefore, similar parts will have the same numeric label. The display panel comprises:

a storage unit 110, for storing a specific grayscale compensation data table, the storage unit 110 being in a timing controller (Tcon IC), wherein the specific grayscale compensation data table being used for performing grayscale compensation to a fix mura area in the display panel.

In the present embodiment, the fixed mura area is a high luminance mura area or a high dark mura area. The grayscale compensation values from the specific grayscale compensation data table are for lessening the the mura phenomenon at the high luminance mura area or the high dark mura area. For example, for high luminance mura area, the grayscale compensation values from the specific grayscale compensation data table are used for reducing the luminance; and high dark mura area, the grayscale compensation values from the specific grayscale compensation data table are used for increasing the luminance so that the high luminance or high dark mura area, after grayscale compensation, can fall into the range able for grayscale compensation.

In the present embodiment, the fixed mura area comprises k pixel, and k is an integer greater than or equal to 2. The specific grayscale compensation data table comprises the compensation values for each of the k pixels at 0-255 grayscales. In the present embodiment, the k pixels have the same grayscale compensation value at the same grayscale to save storage space.

a first obtaining unit 120, for obtaining a current grayscale of the display panel.

a first processing unit 130, for, based on the specific grayscale compensation data table, performing grayscale compensation to the current grayscale of a pixel in the fixed mura area of the display panel.

a third obtaining unit 240, for obtaining supplementary grayscale compensation values corresponding to for all pixels in the fixed mura area.

Accordingly, because after the compensation with grayscale values from the specific grayscale compensation data table, the high dark mura area and high luminance area in the fixed mura area is lessened. For further improving on the display effect, the third obtaining unit 240 further obtains supplementary grayscale compensation values corresponding to for all pixels in the fixed mura area. In the present embodiment, some of the supplementary grayscale compensation values can comprise the grayscale compensation values for all pixels in the active area of the known display panel, i.e., some of the supplementary grayscale compensation values can correspond to the grayscale compensation values for all pixels in the fixed mura area in known technology. In the other embodiments, these supplementary grayscale compensation values can be individually provided compensation values, such as, obtained through an external mura repair system.

a second processing unit 250, for, based on the supplementary grayscale compensation values, performing grayscale compensation to all pixels in the fixed mura area of the display panel.

In the present embodiment, moreover, the grayscale compensation is performed by the second processing unit 250 to all pixels in the fixed mura area of the display pane with the compensation data from the supplementary grayscale compensation values. Accordingly, after the further compensation, the high dark mura area and high luminance area in the fixed mura area is further lessened. After two times of grayscale compensation, the mura phenomenon in the high luminance or high dark mura area can be greatly reduced so as to improve the display effect of the display panel. In addition, in other embodiments of the present invention, the display panel can perform three, four or more times of grayscale compensation to the pixel in the fixed mura area.

It should be noted that each of the embodiments in this specification is described in a progressive manner, each of which is primarily described in connection with other embodiments with emphasis on the difference parts, and the same or similar parts may be seen from each other. For the device embodiment, since it is substantially similar to the method embodiment, the description is relatively simple and the relevant description may be described in part of the method embodiment.

With the above description, the present invention provides the following advantages:

Because the timing controller stores the specific grayscale compensation data table, wherein the specific grayscale compensation data table is used for performing grayscale compensation to a fix mura area in the display panel; based on the specific grayscale compensation data table, the display panel performs grayscale compensation to the current grayscale of a pixel in the fixed mura area of the display panel. Therefore, the display panel does not need to perform grayscale compensation to the pixels in the entire active area, and the stored data amount of grayscale compensation values for mura compensation is less so that the data can be stored in the timing controller of the display panel. As a result, the cost is reduced and the display panel achieves a better display quality.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A mura compensation method for display panel, comprising:

storing a specific grayscale compensation data table in a timing controller, wherein the specific grayscale compensation data table being used for performing grayscale compensation to a fixed mura area in the display panel;

obtaining a current grayscale of the display panel;

based on the specific grayscale compensation data table, performing grayscale compensation to the current grayscale of a pixel in the fixed mura area of the display panel wherein the fixed mura area comprises k pixels, k being an integer greater than or equal to 2; and the specific grayscale compensation data table comprises a grayscale compensation value for each pixel of the k pixels at 0-255 grayscales, the k pixels having the same grayscale compensation value at the same grayscale;

obtaining supplementary grayscale compensation values corresponding to all pixels in the fixed mura area; and based on the supplementary grayscale compensation values, performing grayscale compensation to all pixels in the fixed mura area of the display panel.

2. The mura compensation method for display panel as claimed in claim 1, wherein the step of based on the specific grayscale compensation data table, performing grayscale compensation to the current grayscale of a pixel in the fixed mura area of the display panel comprises:

obtaining a grayscale compensation value corresponding to the current grayscale of the pixel in the fixed mura area from the specific grayscale compensation data table;

based on the corresponding grayscale compensation value, performing grayscale compensation to the pixel in the fixed mura area of the display panel.

3. The mura compensation method for display panel as claimed in claim 1, wherein a ratio between area of the fixed mura area and area of the display panel active area is less than or equal to 1/10.

4. The mura compensation method for display panel as claimed in claim 1 wherein the method comprises:

a step before the step of obtaining benchmark grayscale compensation values for all the pixels in the display panel: storing the supplementary grayscale compensation values of all the pixels in the fixed mura area in a data memory.

* * * * *